United States Patent [19]

Frier

[11] 4,084,520

[45] Apr. 18, 1978

[54] CURRENCY DROP SAFE

[75] Inventor: David Lee Frier, Columbia, S.C.

[73] Assignee: Bankers Trust of South Carolina, Columbia, S.C.

[21] Appl. No.: 720,216

[22] Filed: Sep. 3, 1976

[51] Int. Cl.[2] ..... E05G 1/08

[52] U.S. Cl. ..... 109/56; 109/66; 232/43.3

[58] Field of Search ..... 109/53, 55, 56, 66, 109/50; 232/14, 15, 16, 30, 31, 32, 43.1, 43.3, 44

[56] References Cited

U.S. PATENT DOCUMENTS

| | | | |
|---|---|---|---|
| 1,905,572 | 4/1933 | Sioberg | 109/66 |
| 1,966,705 | 7/1934 | Bremer | 109/66 |
| 2,548,338 | 4/1951 | Behrens | 232/43.3 |
| 3,031,133 | 4/1962 | Jones | 232/44 |

FOREIGN PATENT DOCUMENTS

| | | | |
|---|---|---|---|
| 544,725 | 8/1957 | Canada | 109/53 |

OTHER PUBLICATIONS

German Printed Application - S34909, VIII d/21c, Grzymala, 3-1956.

*Primary Examiner*—Paul R. Gilliam
*Assistant Examiner*—David H. Corbin
*Attorney, Agent, or Firm*—Stevens, Davis, Miller & Mosher

[57] ABSTRACT

An attachment to a safe storing reserve cash, including a lockable hopper mounted on top of the safe to deposit immediately a shipment of cash into the safe without opening the safe, and a lockable container, connected to the hopper and extending partially into the safe, to store temporarily and have access to cash for delivery elsewhere without opening the safe at the time the delivery is to be made. The container is connected to the hopper so as to be concealed when the safe is viewed normally when standing in front of the safe.

3 Claims, 3 Drawing Figures

CURRENCY DROP SAFE

BACKGROUND OF THE INVENTION

This invention relates to a safe, and to an attachment to a safe for depositing cash in the safe and temporarily storing cash to be delivered elsewhere, without opening the safe.

Many banks have safes, located within their vaults, which store reserve cash. These safes generally are used to store shipments of money delivered by armored car or to store money which is to be transferred by armored car to another location. The safes usually have time delay locks which provide for access to the reserve cash at a preset time after the lock is activated, such as a 15 minute delay time. This, however, presents a problem because armored car delivery companies do not want their guards to wait the 15 minutes before a bank teller can open the safe to receive a cash shipment or remove some cash for shipment elsewhere.

Another problem with such time delay safes is that the entire amount of reserve cash stored in the safe must be exposed even though, for example, only a small amount of reserve cash is readied for shipment by armored car, or when cash is deposited in the safe. This problem is extremely significant because armored car companies establish a set schedule in that they normally service each bank on the same day at approximately the same time, and this is easily detected by someone planning a robbery. In fact, a large number of robberies are now occurring within minutes of armored car deliveries and pickups, thereby exposing the entire cash reserve in the safe to the robber.

SUMMARY OF THE INVENTION

It is an object of the invention to provide a novel safe.

It is a further object of the invention to provide a novel unit for attachment to a time delay safe for immediately securing cash inside the safe and storing cash to be transferred out of the bank without exposing the entire contents of the safe.

It is still another object of the present invention to provide a container, which is concealed from normal view, for temporarily storing cash to be transferred out of the bank.

These and other objects are obtained by providing an attachment to a safe storing reserve cash, including a first container, which sits atop the safe, and a second container connected to the first container and extending into the safe. The first container includes a rotatable hopper for immediately transferring money into the safe by placing the money in the hopper and then rotating the hopper to enable the money to fall into the safe. The second container stores money which is to be transferred from the bank on a given day. Each container has a lockable lid to prevent, respectively, access to the safe through the hopper and the cash in the second container. The safe has a separate door and time delay lock to provide for access to the entire contents of the safe.

DETAILED DESCRIPTION OF THE INVENTION

Figure 1:
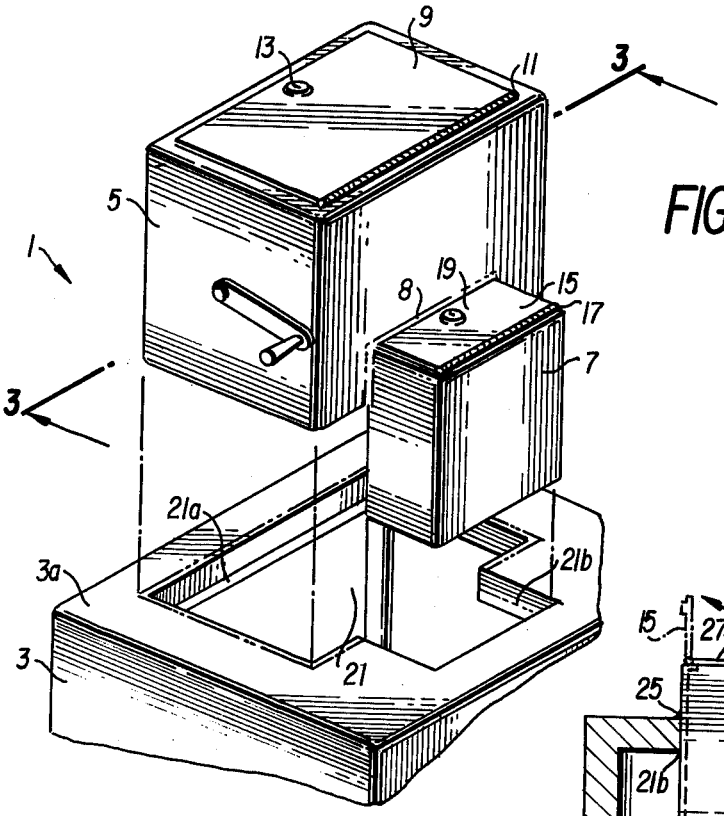
FIG. 1 is a perspective view of the invention.

FIG. 1 discloses a unit 1 for permanent attachment to a safe 3 storing reserve cash. The unit 1 includes a hopper 5 for immediately transferring cash into the safe 3 and a container 7 for temporarily storing a relatively small amount of cash for delivery elsewhere by, for example, armored car. Container 7 is welded to hopper 5 as shown at 8.

Hopper 5 has a lid 9, pivoted to the top by hinge 11, which can be locked with a lock 13. Container 7 also has a lid 15, pivoted to the top by hinge 17, which can be locked with a lock 19. Locks 13 and 19 may be simple key locks which enable, for example, a bank teller to open quickly the hopper 5 to transfer cash into the safe 3 or to place cash in container 7 at any time. Preferably, however, lock 19 is a standard time delay lock having a time delay of, for example, 5 minutes to prevent opening of container 7 until 5 minutes after the lock is activated. Such 5 minute time delay may deter robbers from waiting to have access to the contents of container 7 while not delaying unduly the delivery schedule of an armored car.

Figure 2:
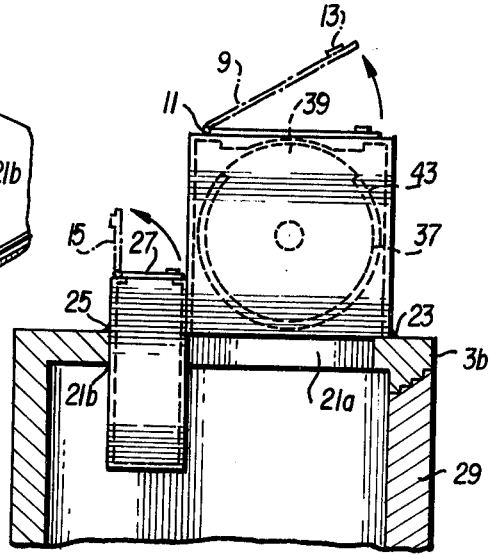
FIG. 2 is a cross-section through a safe having the attachment thereon.
Figure 3:
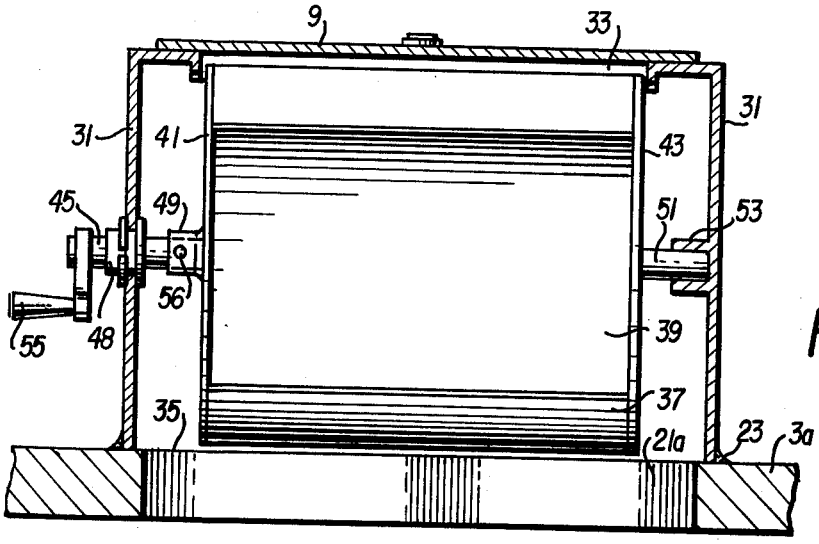
FIG. 3 is a cross-section taken through line 3—3 of FIG. 1.

Safe 3 has a cut-out 21, having two rectangular openings 21*a*, 21*b*, in the top 3*a* of the safe. As shown in FIGS. 2 and 3, hopper 5 is welded at 23 to the top 3*a* of safe 3 and sits over opening 21*a*. Container 7 is welded at 25 to the top 3*a* of safe 3 and extends downwardly through opening 21*b* partially into safe 3. Container 7 has only one opening 27 closable by the lid 15. Safe 3, on its front side 3*b*, has a door 29 which is locked by a time delay lock (not shown) and provides entry to the interior of safe 3 for access to the entire contents of the safe. Container 7 is located on the side of hopper 5 away from the front 3*b* of safe 3 and connected to the hopper so as to be concealed from normal view by a person standing in front of the safe.

As shown in FIG. 3, the hopper 5 includes a housing 31 having an upper opening 33, closable by the lid 9, and a lower opening 35 in communication with opening 21*a*. Inside casing 31 is a circular cylindrical drum 37 having an opening 39 and two end plates 41 and 43. The drum 37 is rotatably supported in casing 31 on one side by a rotatable rod 45 extending through a bearing 47 and into a collar 49 of end plate 41, and on the other side by a rod 51 connected to end plate 43 and rotatably housed in a collar 53. A handle 55 is connected to rod 45 outside casing 31 to rotate the rod 45 and, hence, drum 37 and rod 51. A set screw 56 on collar 49 is used to connect fixedly rod 45 within collar 49.

The unit 1 may be installed in a standard safe 3, or any steel chest, large enough to accommodate the unit by first cutting openings 21*a*, 21*b* into the top 3*a*. The unit 1 is then installed on the safe 3 by placing hopper 5 on surface 3*a* over opening 21*a* and allowing container 7 to pass through opening 21*b* to extend into the safe. The hopper 5 and container 7 then are welded to the safe on all sides as shown at 23, 25. Finally, the safe or chest is repainted where a cutting torch was used to provide openings 21*a*, 21*b*. The unit 1 can be completely installed on site in approximately 1 hour, including the time for repainting.

As one example, hopper 5 may be about 11 inches × 16 inches × 12 inches, and container 7 about 4 inches × 9 inches ×10 inches. Opening 21*a* has about the same dimensions as hopper 5, i.e. about 11 inches × 16 inches and opening 21*b* is about 4 inches × 9 inches corresponding to container 7. The drum 37 has an axial length of about 12 inches and an outside diameter of about 10 inches. Container 7 extends about 8 inches into safe 3. Hopper 5, particularly casing 31, and container 7, may be made of high grade steel about 3/16 inch thick.

With the unit 1, a cash shipment received by armored car service can be safely and immediately deposited in safe 3 without exposing the other reserve case in the safe. When the shipment is received, a bank teller unlocks key lock 13 to open lid 9, then rotates handle 55 to align openings 39 and 33 and places the shipment in the drum 37. The teller then rotates handle 55 to align opening 39 with opening 35, thereby allowing the shipment to fall by gravity into safe 3. The teller then closes the lid 9 and locks it with lock 13. The locked lid 9 prevents anyone from possibly fishing through drum 37 for the contents of safe 3.

Cash which is to be shipped, for example, by armored car service, can be stored in container 7 and the shipment picked-up without requiring access to safe 3 at the time the armored car arrives. For example, the time delay lock on door 3*b* can be set to open at the bank's convenience before the start of business. A teller then can place part of the currency from safe 3 into container 7 for shipment later in the day. The door 3*b* and lid 15 are then closed and locked. When the armored car arrives, the lock 19, if it is the 5 minute time delay lock mentioned above, is activated by the teller to unlock the lid after 5 minutes. The shipment is then given to the armored car guard without requiring access to the entire contents of safe 3.

While the invention has been particularly shown and described with reference to a preferred embodiment thereof, it will be understood by those in the art that various changes in form and detail may be made therein without departing from the spirit and scope of the invention.

What is claimed is:

1. An attachment for a safe comprising a first container having side walls and defining top and bottom openings, a second container attached to one of said side walls but projecting beyond the plane of said bottom opening, said second container defining a top opening, a door for closing each of said top openings, means mounting said first container on the exterior of a safe with the bottom opening of said first container affording communication with the safe interior and with said second container projecting into the safe interior, a third container having a single opening, means mounting said third container within said first container for movement between a position in which its opening is in registry with said top opening of said first container to a position in registry with the bottom opening of said first container whereby money may be placed in the safe through said first container.

2. An attachment as claimed in claim 1, wherein said third container is a hollow drum having a longitudinal opening in one wall, said drum being mounted for rotation about its long axis.

3. An attachment for a safe as claimed in claim 1, further comprising separate means to lock said doors.

* * * * *